US009226644B2

(12) United States Patent
Bastuji et al.

(10) Patent No.: US 9,226,644 B2
(45) Date of Patent: Jan. 5, 2016

(54) DISHWASHER COMPRISING A DRAWER

(75) Inventors: Ismail Cem Bastuji, Istanbul (TR); Guvenc Nayman Numanoglu, Istanbul (TR)

(73) Assignee: Arcelik Anonim Sirketi, Istanbul (TR)

( * ) Notice: Subject to any disclaimer, the term of this patent is extended or adjusted under 35 U.S.C. 154(b) by 1020 days.

(21) Appl. No.: 13/322,076

(22) PCT Filed: May 13, 2010

(86) PCT No.: PCT/EP2010/056619

§ 371 (c)(1), (2), (4) Date: Nov. 22, 2011

(87) PCT Pub. No.: WO2010/133505

PCT Pub. Date: Nov. 25, 2010

(65) Prior Publication Data

US 2012/0062085 A1 Mar. 15, 2012

(30) Foreign Application Priority Data

May 22, 2009 (TR) ..... a 2009 03973

(51) Int. Cl.
*A47L 15/50* (2006.01)
*A47B 88/04* (2006.01)

(52) U.S. Cl.
CPC ..... *A47L 15/507* (2013.01); *A47L 15/502* (2013.01); *A47L 15/503* (2013.01); *A47B 88/0407* (2013.01); *A47B 2088/0448* (2013.01)

(58) Field of Classification Search
CPC ... A47L 15/502; A47L 15/507; A47L 15/503; A47B 88/0407; A47B 2088/0448
USPC ..... 312/228.1; 134/56 D
See application file for complete search history.

(56) References Cited

U.S. PATENT DOCUMENTS

| | | | | |
|---|---|---|---|---|
| 2,799,285 | A * | 7/1957 | Lines | 134/158 |
| 3,556,625 | A * | 1/1971 | Kauffman | 312/301 |
| 6,643,900 | B2 * | 11/2003 | Jahrling | 24/563 |
| 7,493,905 | B2 * | 2/2009 | Jeong et al. | 134/56 D |
| 8,573,720 | B2 * | 11/2013 | Wittgrebe | 312/410 |
| 2005/0241682 | A1 | 11/2005 | Jeong et al. | |
| 2007/0158280 | A1 * | 7/2007 | Cox et al. | 211/26 |
| 2008/0072937 | A1 | 3/2008 | Choi et al. | |

FOREIGN PATENT DOCUMENTS

| | | | |
|---|---|---|---|
| DE | 10218067 | A1 * | 11/2003 |
| EP | 1854395 | A1 | 11/2007 |
| FR | 2389299 | A7 | 11/1978 |

OTHER PUBLICATIONS

Machine translation of DE 10218067 A1, dated Nov. 2003.*

* cited by examiner

*Primary Examiner* — Joseph L Perrin
*Assistant Examiner* — Kevin G Lee
(74) *Attorney, Agent, or Firm* — Venjuris P.C.

(57) ABSTRACT

The present invention relates to a dishwasher (1) that comprises a body (2), a door (3) allowing access into the body (2), at least two hangers (4) secured oppositely on the ceiling (T) of the body (2), at least two rails (5) each mounted to the hangers (4) and at least one drawer (6) mounted to the rails (5) from the opposite sides to be movable thereon, wherein the items to be washed are emplaced.

18 Claims, 6 Drawing Sheets

DISHWASHER COMPRISING A DRAWER

Figure 1:
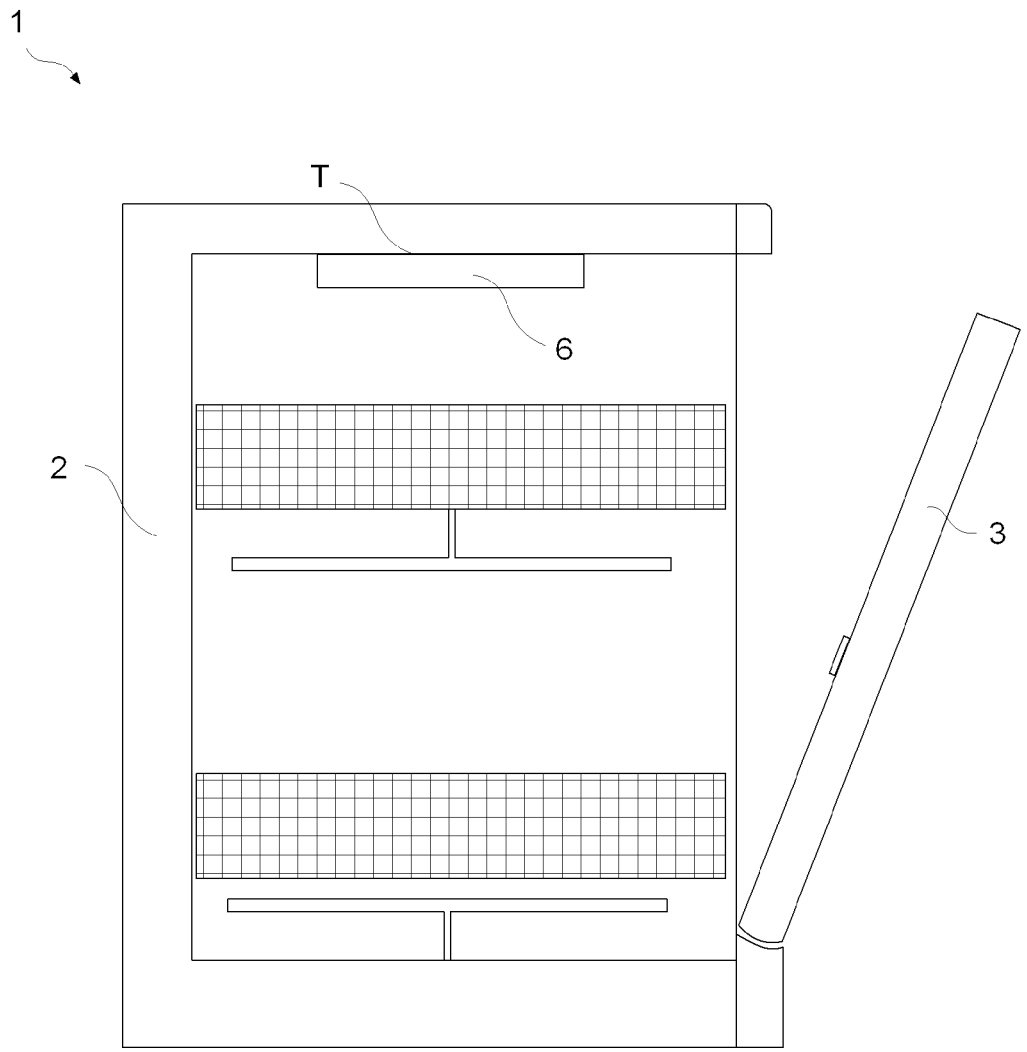

The present invention relates to a dishwasher that comprises a drawer wherein items to be washed are emplaced.

In dishwashers, drawers disposed close to the ceiling are used in addition to the baskets wherein items to be washed are emplaced for effective utilization of the washing space. The drawers are generally suitable for placing long and thin items such as cutlery and thus provide to utilize the dead space inside the washing chamber. In implementations known in the technique, the drawers are opened and closed by moving on mechanisms such as rails, guides etc. mounted on the portions of the side walls close to the ceiling.

In order to solve this problem, in the state of the art United States of America patent application no US2005241682, a dishwasher is described that comprises guide rails mounted to the ceiling and a top rack disposed to be movable in front and rear directions at a position close to the ceiling.

However in these state of the art embodiments when the drawer is not desired to be used, even if taken out of the dishwasher, the mechanisms used for supporting the drawer such as rails, slides etc. occupy space inside the dishwasher and prevent efficient usage of the upper dish rack.

The aim of the present invention is the realization of a dishwasher comprising a drawer that increases the loading capacity by allowing effective utilization of the interior volume.

The dishwasher realized in order to attain the aim of the present invention is explicated in the attached claims.

The dishwasher of the present invention comprises at least two hangers secured oppositely to the ceiling of the body, at least one rail mounted to the hangers and at least one drawer movably mounted on the rails from its opposite sides wherein the items to be washed are placed.

The rail has an active position whereon the drawer can be mounted and a passive position wherein it can be closed on the ceiling by rotating without being taken off the hanger.

In the preferred embodiment of the present invention, the rail is in a horizontally-tilted U shape and comprises a drawer arm and a hanger arm. The hanger arm is mounted to the hanger such that it can rotate around itself and slide back and forth and extends parallel to the ceiling from the front backwards. In the active mode of the rail, the hanger arm moves back and forth allowing the drawer to be pulled out. And in the active mode of the rail, the hanger arm allows the rail to be closed under the ceiling by rotating inside the hanger. As for the drawer arm, it extends parallel to the hanger arm in the same direction. In the active mode of the rail, the drawer arm remains below the hanger arm and stands next to the hanger arm when the rail is changed to the passive mode by being rotated. In the active mode of the rail, the drawer is mounted on the drawer arm and moves back and forth on the drawer arm.

The rail is fixed under the ceiling by means of a fixing element in the passive mode. The fixing element preferably comprises two protrusions situated on the hanger. When the rail is changed to the passive mode, the drawer arm gets stuck between the protrusions and thereby provides the rail to be fixed under the ceiling.

The hanger comprises at least one detent means so that the hanger arm can be mounted movably. The hanger arm is fitted into the detent means and slides back and forth during the movement of the rail in the detent means with respect to the dishwasher.

The hanger furthermore comprises at least one stopper disposed virtually opposite the detent means. The stopper guides the movement during the motion of the rail inside the detent means and prevents the rail being dislodged from the detent means.

The dishwasher furthermore comprises at least one lid that covers the open ends of the hanger arm and the drawer arm. The lid prevents the rail being dislodged from the channel and the detent means when the drawer is pulled to the end limit. The lid is removably mounted on the said ends and the drawer can be entirely taken out of the dishwasher when the lid is removed.

By means of the present invention, not only the dead spaces in the dishwasher are utilized by a drawer wherein the items such as cutlery etc. can be placed but also the space occupied in the dishwasher by the elements supporting and providing movement of the drawer are minimized when the drawer is not in use. Thus, the space of the drawer and hence the dishwasher can be used effectively.

The model embodiments relating to the dishwasher realized in order to attain the aim of the present invention are illustrated in the attached figures, where:

FIG. 1—is the schematic view of a dishwasher.

Figure 2:
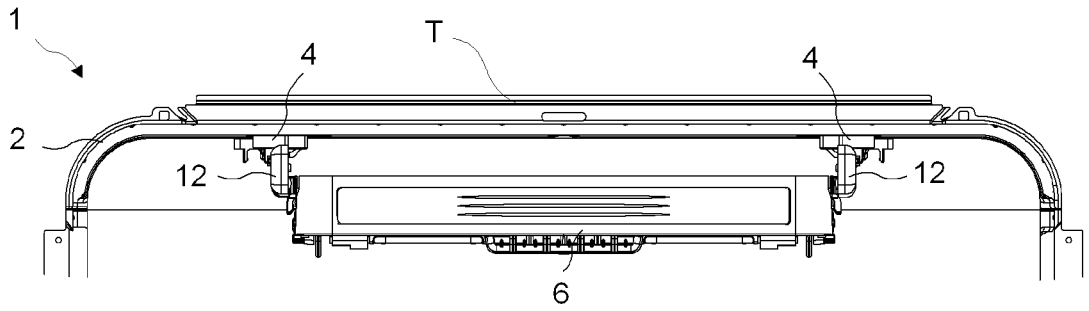

FIG. 2—is the front view of the dishwasher when the drawer is mounted.

Figure 3:
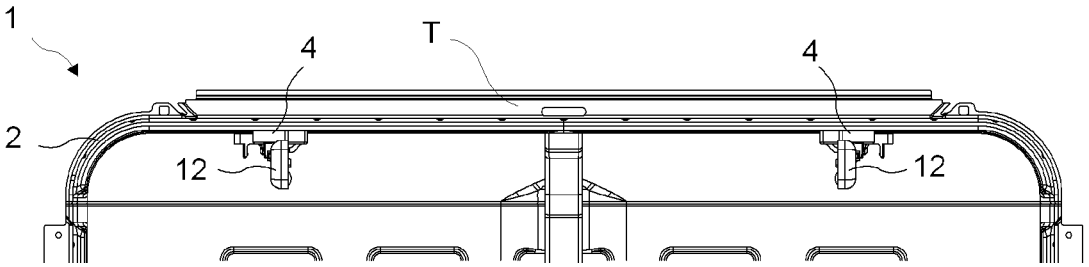

FIG. 3—is the front view of the dishwasher when the rail is in the active mode and the drawer is not mounted.

Figure 4:
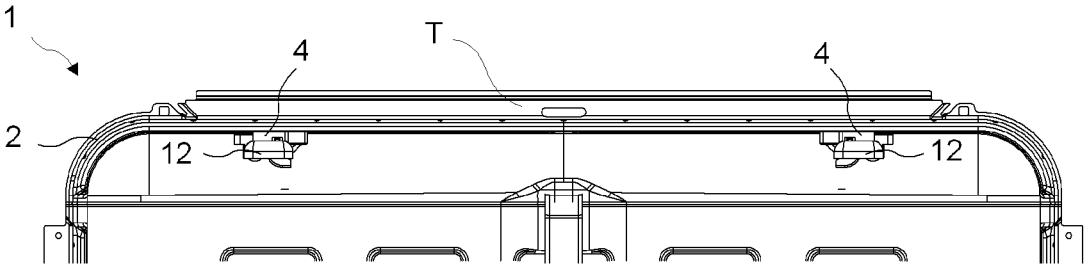

FIG. 4—is the front view of the dishwasher when the rail is in the passive mode.

Figure 5:
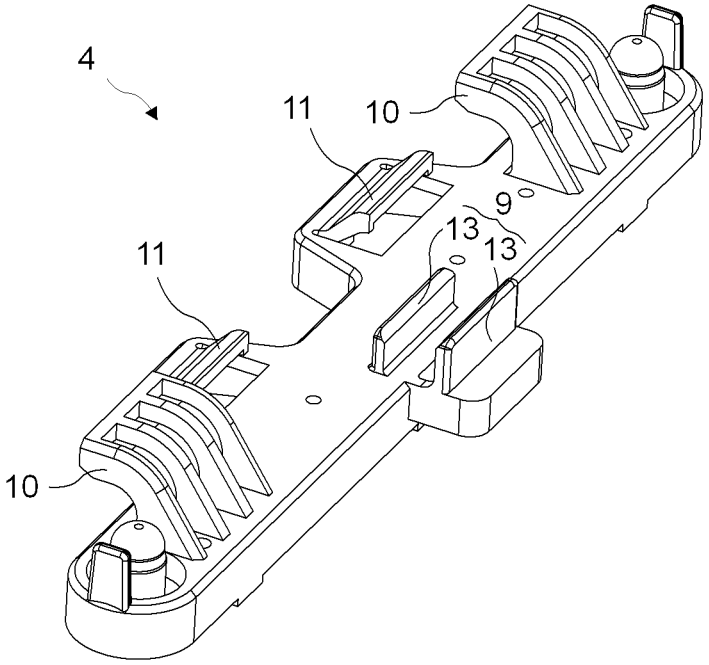

FIG. 5—is the perspective view of the hanger.

Figure 6:
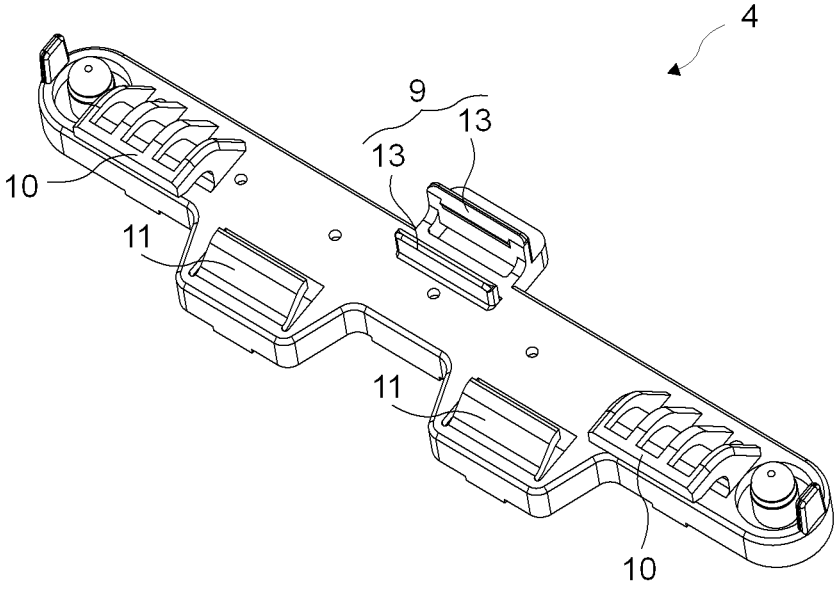

FIG. 6—is the perspective view of the rail from another angle.

Figure 7:
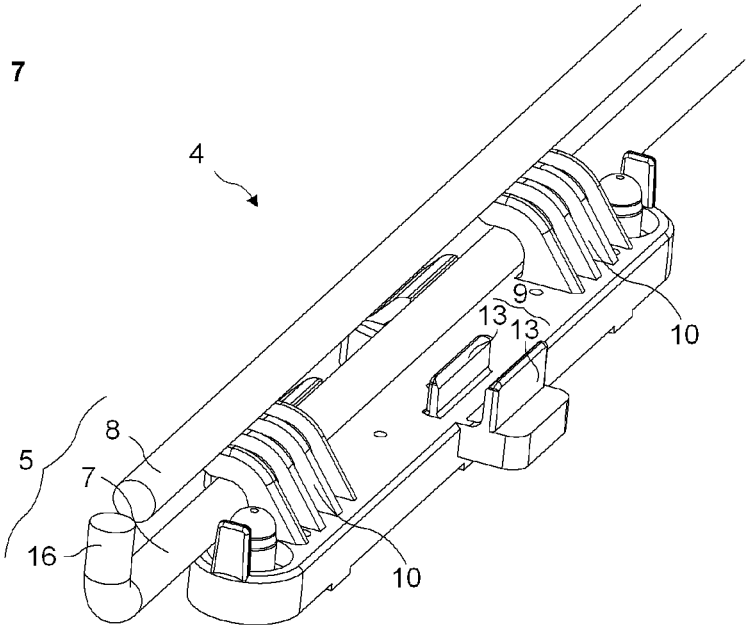

FIG. 7—is the perspective view of the hanger and the rail when the rail is in the active mode.

Figure 8:
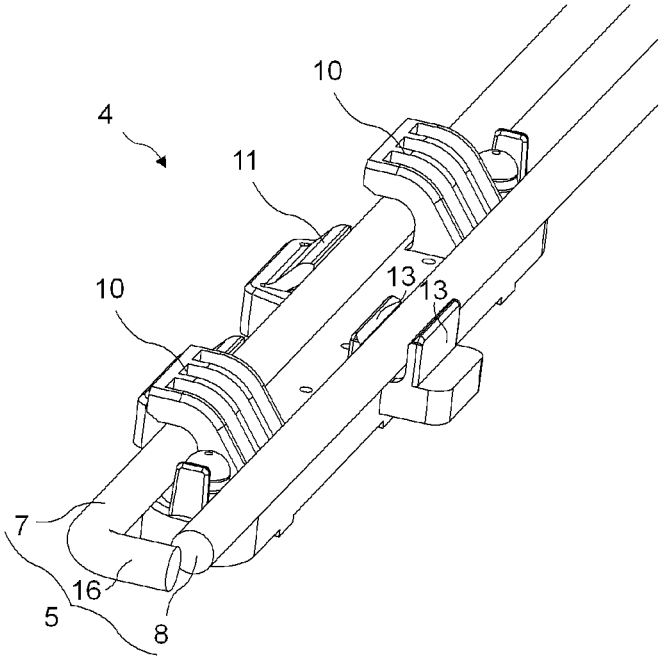

FIG. 8—is the perspective view of the hanger and the rail when the rail is in the passive mode.

Figure 9:
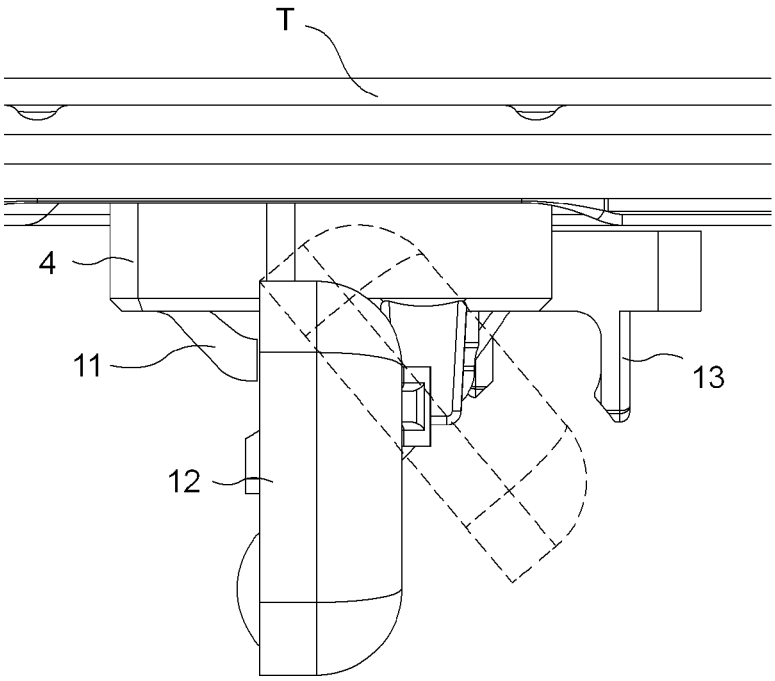

FIG. 9—is the perspective view of the rail and the lid when the rail is in the active mode.

Figure 10:
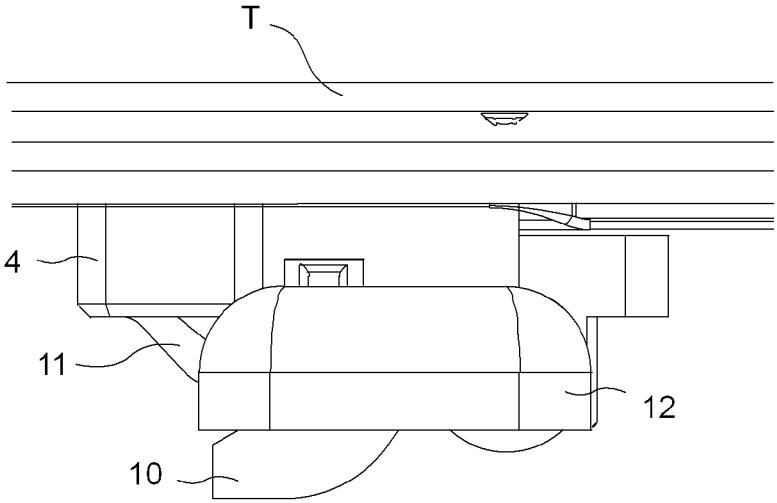

FIG. 10—is the perspective view of the rail and the lid when the rail is in the passive mode.

Figure 11:
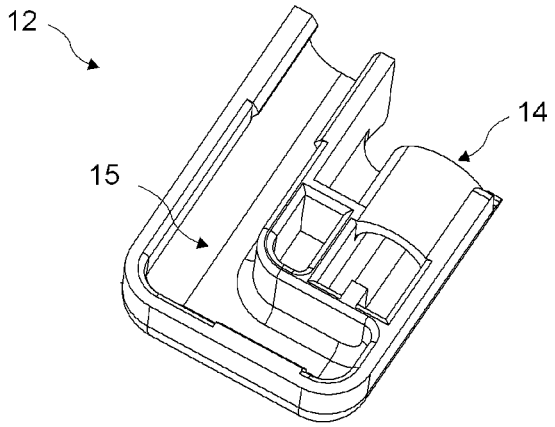

FIG. 11—is the perspective view of the lid.

Figure 12:
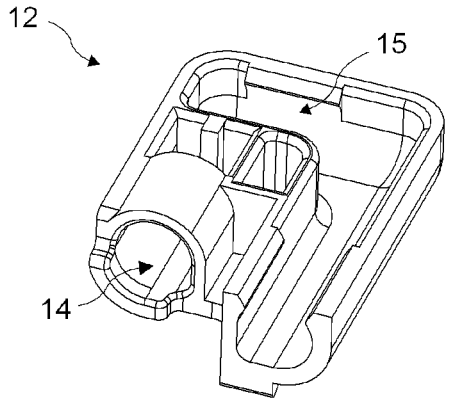

FIG. 12—is the perspective view of the lid from another angle.

Figure 13:
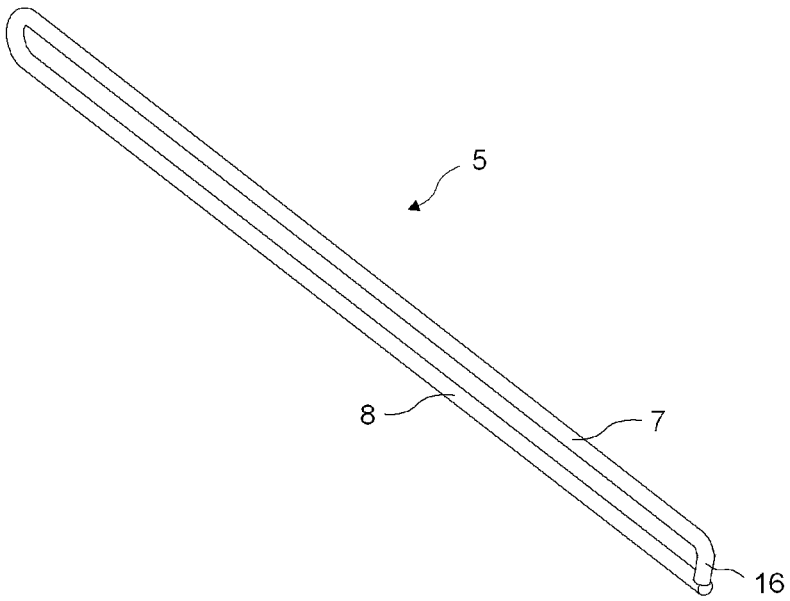

FIG. 13—is the perspective view of the rail.

The elements illustrated in the drawings are numbered as follows:

1. Dishwasher
2. Body
3. Door
4. Hanger
5. Rail
6. Drawer
7. Hanger arm
8. Drawer arm
9. Fixing element
10. Detent means
11. Stopper
12. Lid
13. Protrusion
14. Channel
15. Housing
16. Extension The dishwasher (1) comprises a body (2), a door (3) allowing access into the body (2), at least two hangers (4) secured oppositely on the ceiling (T) of the body (2), at least one rail (5) each mounted to the hangers (4) and at least one drawer (6) secured to the rails (5) from the opposite sides to be movable thereon, wherein the items to be washed are emplaced (FIG. 1, FIG. 2 and FIG. 3).

The rail (5) has an active mode wherein the drawer (6) can be mounted thereon and a passive mode wherein it can be closed under the ceiling (T) by rotating and without being taken off the hanger (4) (FIG. 3 and FIG. 4).

In the preferred embodiment of the present invention, the rail (5) is of a horizontally-tilted U shape and comprises:

a hanger arm (7)

mounted to the hanger (4) to be rotatable around itself, extending from the front backwards parallel to the ceiling (T), allowing the rail (5) in the active mode to move back and forth on the hanger (4) and the rail (5) in the passive mode to close under the ceiling (T) by rotating around itself and a drawer arm (8)

that extends parallel to the hanger arm (7) in the same direction, positioned under the hanger arm (7) in the active mode of the rail (5), whereon the drawer (6) is mounted and allowing back and forth movement of the drawer (6) on the rail (5), and coming next to the hanger arm (7) by rotating such that the hanger arm (7) is the rotational axis in the passive mode of the rail (5).

In this embodiment, in the active mode of the rail (5), the hanger arm (7) and the drawer arm (8) extend one over the other, and in the passive mode extend side by side under the ceiling (T) being parallel to each other and to the ceiling (T). In the active mode, the drawer (6) is mounted on the drawer arm (8) and the drawer arm (8) provides the drawer (6) to move back and forth on the rail (5).

The dishwasher (1) furthermore comprises a fixing element (9) that enables the rail (5) to be secured to remain under the ceiling (T) in the passive mode (FIG. 7 and FIG. 8).

In the preferred embodiment of the present invention, the fixing element (9) is situated on the hanger (4) and comprises at least two protrusions (13) with the distance therebetween being approximately equal to the thickness of the drawer arm (8) such that the drawer arm (8) is stuck therebetween when the rail (5) is changed to the passive mode (FIG. 7 and FIG. 8).

The hanger (4) furthermore comprises at least one detent means (10) that supports the hanger arm (7) slidingly by at least partially clasping thereof and at least one stopper (11) in a pop-up form, disposed almost opposite the detent means (10), preventing the hanger arm (7) being dislodged from inside the detent means (10) while moving (FIG. 5 and FIG. 6).

In the preferred embodiment of the present invention, the stopper (11) closes by stretching when pressed upon by the hanger arm (7) during emplacing the hanger arm (7) into the hanger (4) and thus enables the hanger arm (7) to be seated inside the detent means (10). After the hanger arm (7) is placed into the detent means (10) by passing the stopper (11), when the force acting thereon is released the stopper (11) gets free again and serves as a barrier preventing the hanger arm (7) to be dislodged from the detent means (10) (FIG. 5 and FIG. 6).

The dishwasher (1) furthermore comprises at least one lid (12) that covers the open ends of the hanger arm (7) and the drawer arm (8) for preventing the rail (12) being dislodged from inside the detent means (10) during the movement of the drawer (6) (FIG. 9 to FIG. 12).

In different embodiments of the present invention, the lid (12) comprises an L shaped housing (15) wherein the open end of the hanger arm (7) is seated and a channel (14) with a closed top wherein the open end of the drawer arm (8) is seated (FIG. 11 and FIG. 12).

In this embodiment, the rail (5) comprises an extension (16) disposed at the open end of the hanger arm (7), extending towards the drawer arm (8) almost vertically to the hanger arm (7), that is seated in the housing (15) when the lid (12) is mounted. The extension (16) prevents the unwanted dislodging of the lid (12) when the drawer (6) is pulled forward to the end limit and makes the connection of the lid (12) with the rail (5) more durable.

In the preferred embodiment of the present invention, the rail (5) is configured by bending a single wire in a U shape. (FIG. 13).

The open ends of the rails (5) preferably face the door (3). Accordingly, when the drawer (6) is desired to be removed from the rails (5), first the lids (12) that cover the open ends of the rails (5) are dismounted and afterwards the drawer arm (8) is removed from the hanger (4) by pulling the drawer (6) forward. Thus, the drawer (6) can be entirely taken out from the dishwasher (1). Afterwards, the lids (12) are remounted in place, the rails (5) are changed from the active mode to the passive mode and fixed by means of the fixing element (9) in this position.

Since the rails (5) can be changed to the passive mode when the drawer (6) is dislodged, the dead spaces that can't be used because of the rail (5) are eliminated thereby saving space in the case the drawer (6) is not used.

It is to be understood that the present invention is not limited to the embodiments disclosed above and an expert in the technique can easily introduce different embodiments. These should be considered within the scope of the protection postulated by the claims of the present invention.

The invention claimed is:

1. A dishwasher (1) that comprises a body (2), a door (3) allowing access into the body (2), at least two hangers (4) secured oppositely on the ceiling (T) of the body (2), at least one rail (5) each mounted to the hangers (4) and at least one drawer (6) secured to the rails (5) from the opposite sides to be movable thereon, wherein the items to be washed are emplaced, and characterized by the rail (5) having an active mode wherein the drawer (6) can be mounted thereon and a passive mode wherein the rail (5) can be closed under the ceiling (T) by rotating, without being taken off the hanger (4) wherein the rail (5) is of a horizontally tilted U shape having a hanger arm (7) that is mounted to the hanger (4) to be rotatable around itself and extending from the front backwards being parallel to the ceiling (T) and a drawer arm (8) that extends parallel to the hanger arm (7) and in the same direction, remaining under the hanger arm (7) in the active mode of the rail (5) and a drawer arm (8) whereon the drawer (6) is mounted, that rotates to come next to the hanger arm (7) such that the hanger arm (7) is the rotation axis in the passive mode of the rail (5).

2. The dishwasher (1) as in claim 1, characterized by a fixing element (9) that enables the rails (5) to be secured to remain under the ceiling (T) in the passive mode.

3. The dishwasher (1) as in claim 2, characterized in that the fixing element (9) comprises two protrusions (13) situated on the hanger (4), with the distance therebetween being approximately equal to the thickness of the drawer arm (8) such that the drawer arm(8) is stuck therebetween when the rail (5) is changed to the passive mode.

4. The dishwasher (1) as in claim 1, characterized by the hangers (4) comprising at least one detent means (10) that supports the hanger arm (7) slidably by at least partially clasping thereof and at least one stopper (11) in a pop-up form, disposed almost opposite the detent means (10), preventing the hanger arm (7) being dislodged from inside the detent means (10) while moving.

5. The dishwasher (1) as in claim 1, characterized by at least one lid (12) that closes the open ends of the hanger arm (7) and the drawer arm (8) in order to prevent the rail (5) being dislodged from inside the detent means (10) during the movement of the drawer (6).

6. The dishwasher (1) as in claim 5, characterized in that the lid (12) comprises an L shaped housing (15) wherein the open end of the hanger arm (7) is seated and a channel (14) with a closed top wherein the open end of the drawer arm (8) is seated.

7. The dishwasher (1) as in claim 6, characterized by an extension (16) disposed at the open end of the hanger arm (7), extending towards the drawer arm (8) being almost vertical to the hanger arm (7) that is seated in the housing (15) when the lid (12) is mounted.

8. The dishwasher (1) as in claim 1, characterized in that the rail (5) is formed by bending a single wire in a U shape.

9. The dishwasher (1) as in claim 1, characterized by rails (5), with the open ends thereof facing the door (3).

10. A dishwasher (1) that comprises a body (2), a door (3) allowing access into the body (2), at least two hangers (4) secured oppositely on the ceiling (T) of the body (2), at least one rail (5) mounted to each hanger (4) and at least one drawer (6) secured to the rails (5) from the opposite sides to be movable thereon, wherein the items to be washed are emplaced, and characterized by the rail (5) having an active mode wherein the drawer (6) can be mounted thereon and a passive mode wherein the rail (5) can be closed under the ceiling (T) by rotating, without being taken off from the hanger (4) so as to ensure that the space occupied by the rails (5) is minimized when not in use and wherein the rail (5) is of a horizontally-tilted U shape having a hanger arm (7) that is mounted to the hanger (4) to be rotatable around itself and extending from the front backwards being parallel to the ceiling (T) and a drawer arm (8) that extends parallel to the hanger arm (7) in the same direction, under the hanger arm (7) in the active mode of the rail (5) whereon the drawer (6) is mounted and allowing back and forth movement of the drawer (6) on the rail (5), and coming next to the hanger arm (7) by rotating such that the hanger arm (7) is the rotation axis in the passive mode of the rail (5).

11. The dishwasher (1) as in claim 10, characterized by a fixing element (9) that enables the rails (5) to be secured to remain under the ceiling (T) in the passive mode.

12. The dishwasher (1) as in claim 10, characterized in that the fixing element (9) comprises two protrusions (13) situated on the hanger (4), with the distance therebetween being approximately equal to the thickness of the drawer arm (8) such that the drawer arm(8) is stuck therebetween when the rail (5) is changed to the passive mode.

13. The dishwasher (1) as in claim 10, characterized in that the hangers (4) comprising at least one detent means (10) that supports the hanger arm (7) slidably by at least partially clasping thereof and at least one stopper (11) in a pop-up form, disposed almost opposite the detent means (10), preventing the hanger arm (7) being dislodged from inside the detent means (10) while moving.

14. The dishwasher (1) as in claim 10, characterized by at least one lid (12) that closes the open ends of the hanger arm (7) and the drawer arm (8) in order to prevent the rail (5) being dislodged from inside the detent means (10) during the movement of the drawer (6).

15. The dishwasher (1) as in claim 14, characterized in that the lid (12) comprises an L shaped housing (15) wherein the open end of the hanger arm (7) is seated and a channel (14) with a closed top wherein the open end of the drawer arm (8) is seated.

16. The dishwasher (1) as in claim 15, characterized by an extension (16) disposed at the open end of the hanger arm (7), extending towards the drawer arm (8) being almost vertical to the hanger arm (7) that is seated in the housing (15) when the lid (12) is mounted.

17. The dishwasher (1) as in claim 10, characterized in that the rail (5) is formed by bending a single wire in a U shape.

18. The dishwasher (1) as in claim 10, characterized by rails (5), with the open ends thereof facing the door (3).

* * * * *